US005486097A

United States Patent [19]

Schaffner

[11] Patent Number: 5,486,097

[45] Date of Patent: Jan. 23, 1996

[54] CONTROL FOR A VARIABLE DISPLACEMENT AXIAL PISTON PUMP

[75] Inventor: Larey D. Schaffner, Baltimore, Ohio

[73] Assignee: Denison Hydraulics Inc., Marysville, Ohio

[21] Appl. No.: 378,712

[22] Filed: Jan. 26, 1995

[51] Int. Cl.[6] ..... F04B 1/26

[52] U.S. Cl. ..... 417/222.1; 417/218

[58] Field of Search ..... 417/221, 218, 417/222.1, 222.2

[56] References Cited

U.S. PATENT DOCUMENTS 5,076,145 12/1991 Born et al. ..... 417/222.1 X 5,135,362 8/1992 Martin ..... 417/222.1

5,183,393 2/1993 Schaffner ..... 417/222.1 X 5,297,941 3/1994 Park ..... 417/222.1 X

*Primary Examiner*—Richard E. Gluck

*Attorney, Agent, or Firm*—Thomas S. Baker, Jr.

[57] ABSTRACT

A torque limiter control sets the limit of power which may be absorbed by a pump. A feedback system adjusts the displacement of the pump in responses to changes in the pressure of working fluid at the pump outlet to maintain a set power.

8 Claims, 6 Drawing Sheets

CONTROL FOR A VARIABLE DISPLACEMENT AXIAL PISTON PUMP

BACKGROUND OF THE INVENTION

Conventionally, a motor driven, variable displacement, axial piston, hydraulic pump drives a hydraulic device such as a motor or cylinder to operate some type of machine. During the operation of the machine its power requirements may vary widely depending upon the work it is doing. Consequently, the power output of the hydraulic pump which drives it also may vary extensively. Often the power output of the hydraulic pump will be limited only when the pressure of the working fluid at the output port of the pump exceeds a set maximum. For example, a pressure compensated, axial piston, hydraulic pump commonly utilizes a pressure compensating control device which reduces the displacement of the pump when the pressure of the working fluid at the pump outlet port exceeds the pressure setting of the compensating mechanism. Because this device responds only to a set maximum pressure for working pressure fluid at a pump outlet, and works independently of pump displacement, the power output of the pump may vary widely. Thus, the pressure compensating mechanism does not serve to limit the amount of power a pump may absorb.

In some instances, a hydraulic device may demand more power than the motor or prime mover driving it is capable of delivering. This may occur whether the prime mover is driving a single hydraulic device or multiple hydraulic devices. When the hydraulic system absorbs more power than the prime mover is capable of delivering, the prime mover becomes overloaded. If the prime mover is a gasoline or diesel engine, the device may stall. If the prime mover is an electric motor, the electric motor may experience a premature failure. Consequently, it has been found desirable to limit the amount of input horsepower which a hydraulic device such as a variable displacement, axial piston pump may absorb.

Pump horsepower may be determined by multiplying a constant by the flow rate and the pressure of the working fluid output by the pump. One type of power limited device which limits the horsepower output of a variable displacement, axial piston pump to a constant set power may be seen in U.S. Pat. No. 5,183,393 to Schaffner. This device looks at the flow rate and the pressure of the working pressure fluid in the pump outlet. As flow rate changes the pressure setting of a compensator mechanism adjusts to maintain a constant power setting.

It has been found desirable for some applications to provide an easily adjustable displacement control which may be set manually, hydraulically or electro hydraulically from a remote location. The torque limiter device of the instant invention may be adapted easily to act as such a displacement control.

SUMMARY OF THE INVENTION

The subject invention provides a torque limiter control for setting the power output of a variable displacement, pressure compensated pump having an inlet and working pressure fluid outlet, a movable swash plate, a movable control piston mounted in a first bore and attached to the swash plate for setting the displacement of the pump and movable between a first control position of maximum pump displacement and a second control position of minimum pump displacement and a spring for spring biasing the control piston towards the first position. The control has a housing having a second bore for receiving a metering compensator spool. The second bore has a tank port adapted to be connected to case, an outlet port adapted to receive control pressure fluid, and a control port adapted to be connected to said first bore of said control piston. A metering compensator spool slideably mounted in the second bore has a metering orifice and a metering land and is movable between a first spool position in which the outlet port is in fluid communication with the control port such that the control pressure fluid is directed to the control piston to move the piston towards said second control position, a second spool position in which the tank port is in fluid communication with the control port such that pressure fluid is drained from the control piston to enable the spring to bias the control piston towards the first control position and an intermediate position in which the control port is blocked by the land. A source of control pressure fluid is connected to the metering orifice in the second bore. A hollow vent sleeve having a vent port slidable in a third bore which bore is downstream of and in fluid communication with the metering orifice such that the vent port receives control pressure fluid which passes through the orifice and a vent spool slidable in a fourth bore having a sealing end which engages and overlies said vent port is mounted in the housing. A torque limiter set adjustment applies a torque setting force to the vent spool to bias the vent spool sealing end against the vent port to prevent fluid in the vent port from exiting the vent port at its interface with the sealing end and thereby causing a pressure drop across the metering orifice until the pressure of the control fluid provides a force which exceeds that of the torque limiter set adjustment. A feedback link pin is connected to and movable with the control piston to indicate pump displacement. A pivotal feedback link is drivingly connected to the feedback pin and the vent sleeve such that the feedback link causes the vent sleeve to slide in the third bore in response to movement of the control piston and thereby modulate the torque setting force at the interface of the vent port and the sealing end of the vent spool as pump displacement changes.

DESCRIPTION OF THE PREFERRED EMBODIMENT

Figure 1:
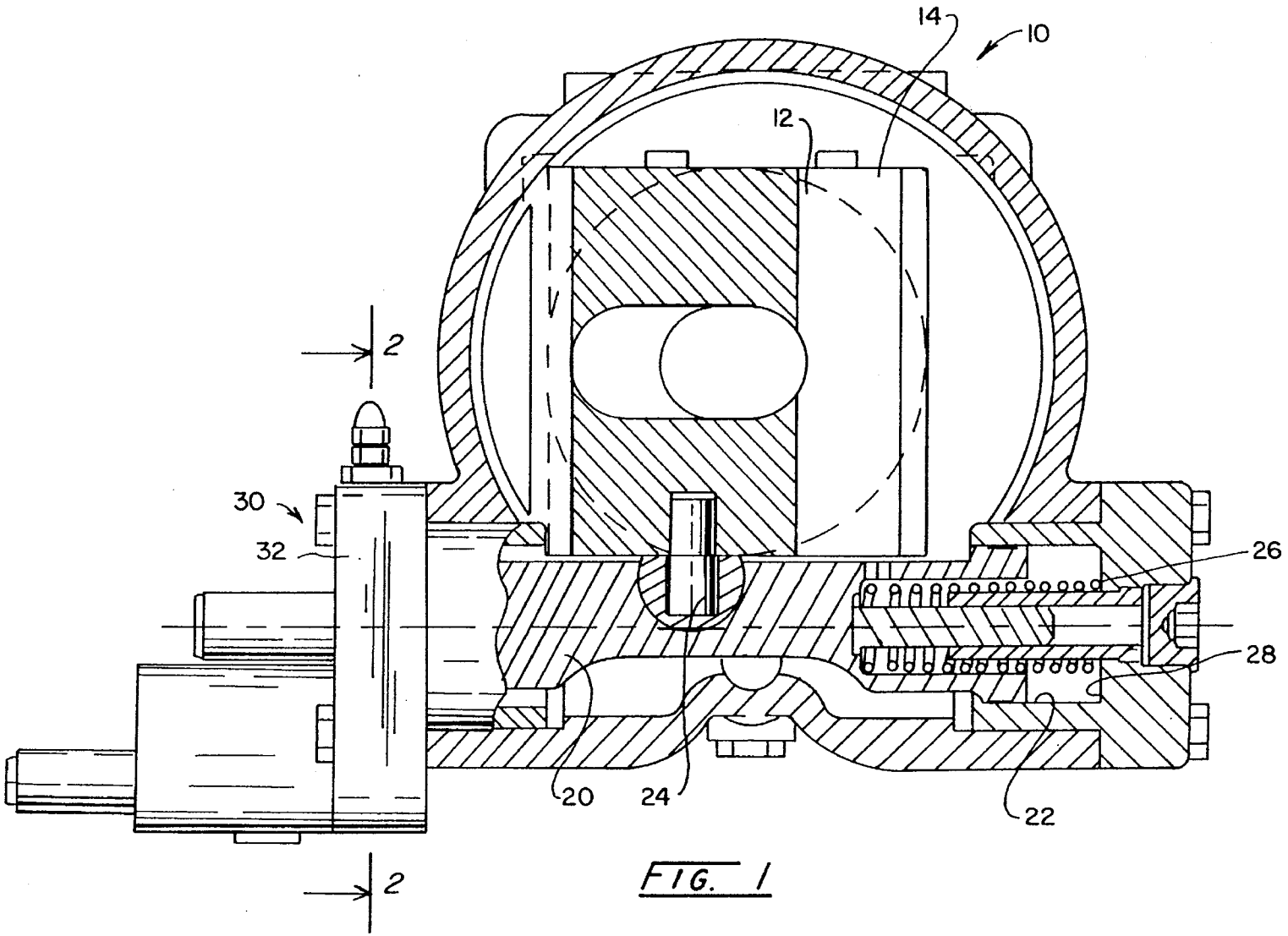
FIG. 1 is a part sectional view of a torque limiter control of the instant invention illustrating the connection of a control piston to the movable cam of a variable displacement axial piston pump.
Figure 6:
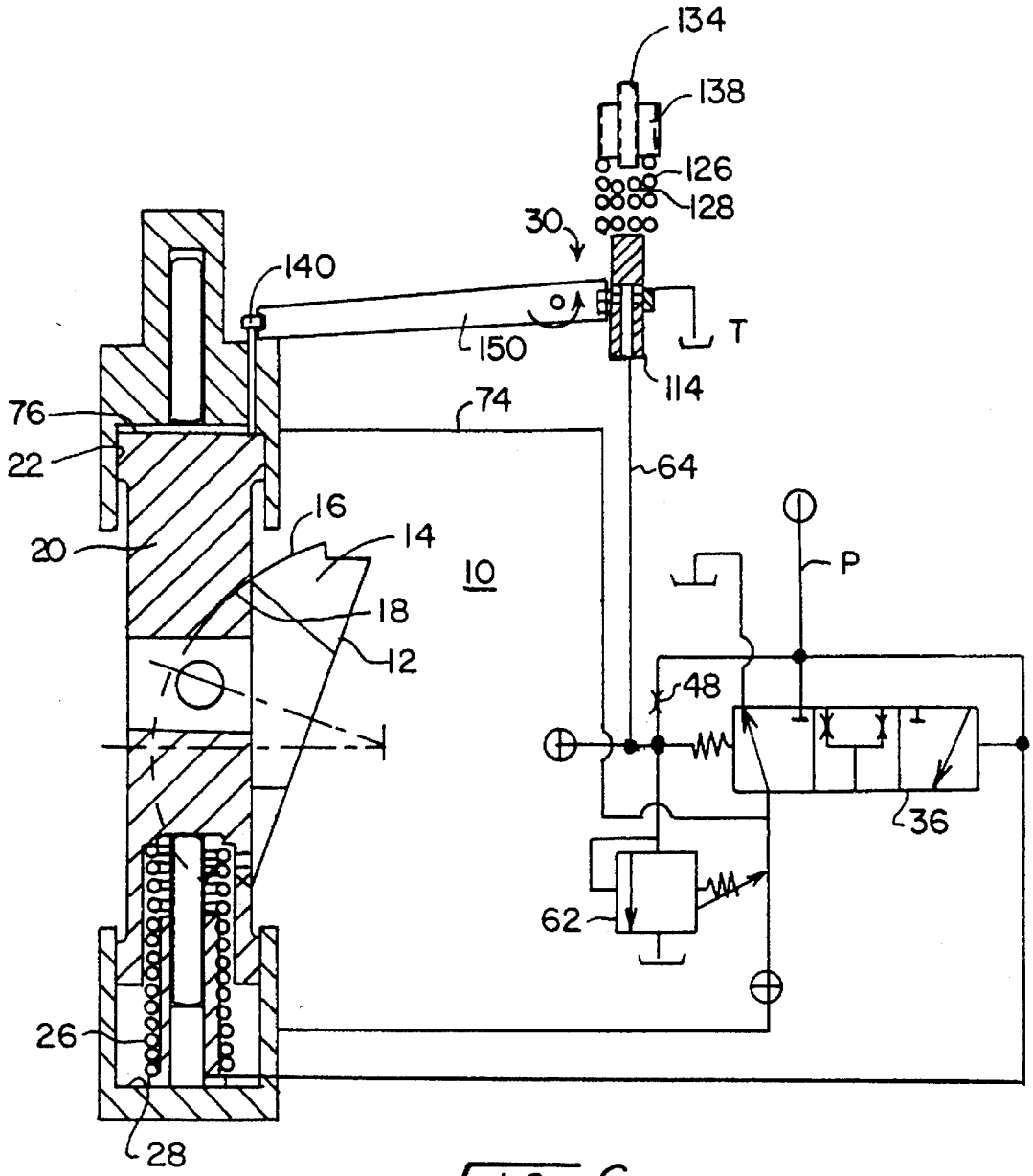
FIG. 6 is a hydraulic schematic of a system pressure fed, manually controlled torque limiter control having a compensator override as described in preferred embodiment of the invention.
Figure 7:
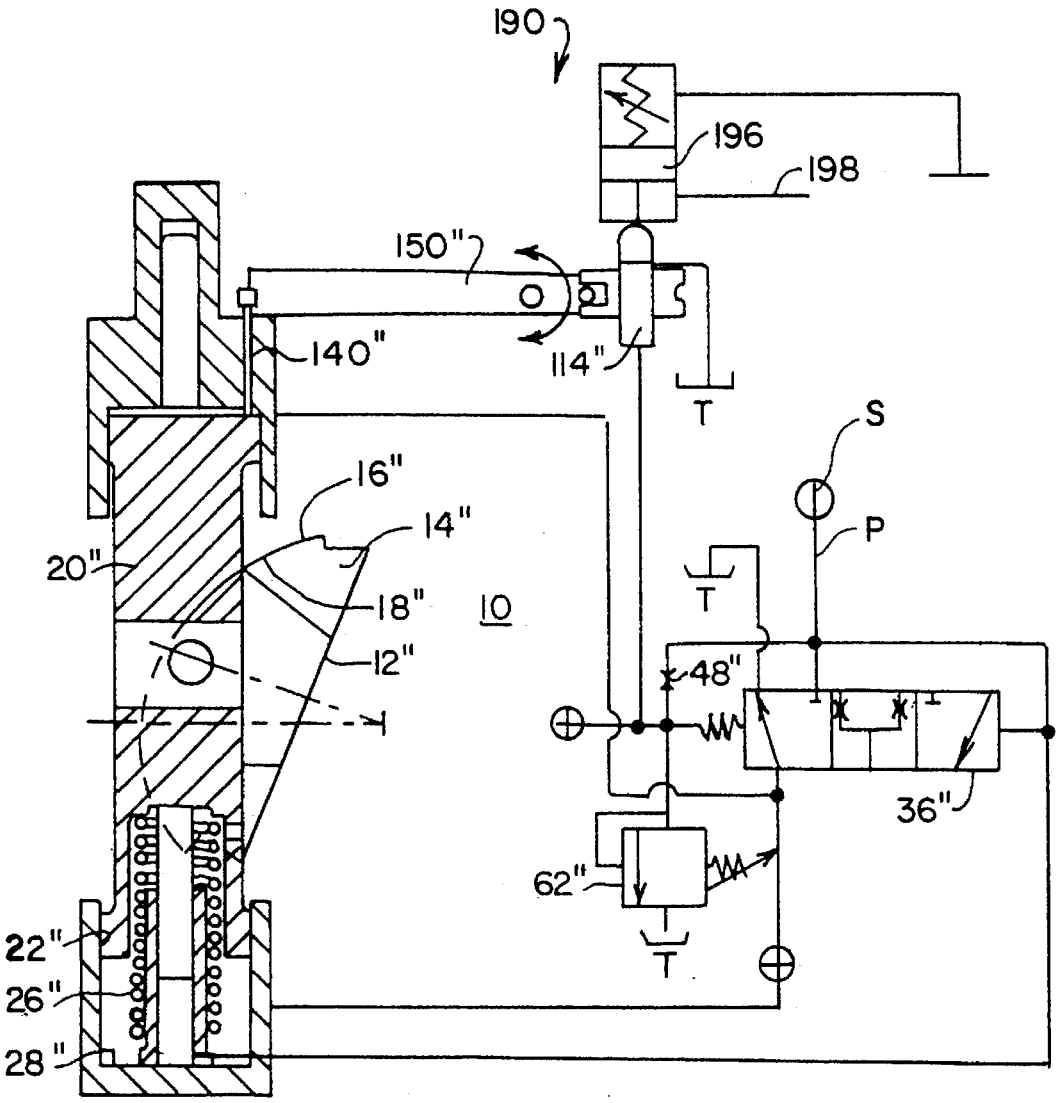
FIG. 7 is a hydraulic schematic of a servo pressure fed hydraulic control for a displacement control with no compensator override.

Turning to FIGS. 1, 6 and 7, a variable displacement, axial piston pump 10 has a planer swash plate 12 mounted on a pivotal rocker cam 14. A curved rear surface 16 of rocker cam 14 is received within a complementary shaped surface 18 formed within a pump housing, not shown, to enable the cam 14 and swash plate 12 to pivot and thereby set the displacement of the pump 10 in a well known manner. Conventionally, an electric motor, not shown, rotates a pump barrel containing a plurality of pistons and cylinder bores which reciprocate to pump fluid. One end of each piston slides on the face of swash plate 12 causing the pistons to reciprocate in the piston bores when the face of swash plate 12 is non-perpendicular to the axis of the piston bores. When swash plate 12 is aligned perpendicular to the piston bores the pump is at a position of minimum fluid displacement whereas when swash plate 12 is rotated such that the face thereof is at a maximum angle with respect to the axis of the piston bores the pump is at a position of maximum fluid displacement. Such variable displacement, swash plate, axial piston pumps are conventional and are well known in the art.

Swash plate 12 and rocker cam 14 are moved between positions of minimum and maximum pump displacement by a control piston 20 movable in a bore 22 and connected to rocker cam 14 by means of a linkage 24. A spring 26 acts between one end 28 of cylinder bore 22 and control piston 20 to bias the piston 20 in a direction which pivots rocker cam 14 and swash plate 12 to a position of maximum fluid displacement. Pump 10 has an inlet, not shown, through which it receives fluid from case T and an outlet, not shown, through which it discharges pressure fluid to drive a fluid motor, cylinder or other such device in a conventional manner.

The pump depicted in FIGS. 1 through 6 utilizes a pressure compensator override mechanism 62. This mechanism monitors the pressure of the working fluid at the outlet of the pump and acts to reduce the displacement of the pump when the pressure exceeds the setting of the override control. So long as the pressure of the working fluid does not exceed the setting of the override mechanism, the control remains inactive. A description of the compensator override mechanism follows hereinbelow.

The torque limiter control 30 of the instant invention operates to maintain a constant set power which may be input to the pump 10. This control monitors the pressure of the working fluid output from the pump. Initially, the torque limiter control 31 is adjusted to provide a maximum pressure for the working fluid (which maximum is below that of the setting of the pressure compensator override mechanism 62) when the pump is at a given displacement for flow rate between its maximum and minimum displacement positions. Should the pressure of the working fluid at the outlet of the pump fall the torque limiter control acts to increase the displacement of the pump until the displacement and pressure setting for the pump equal the power setting of the torque limiter control. Similarly, if the pressure of the working fluid at the output of the pump increases, the torque limiter control acts to reduce the displacement of the pump until the pressure and displacement combination again equal the power setting of the torque limiter control 30. In other words, the torque limiter control 31 functions to adjust the displacement of the pump in response to changes in the pressure of the working fluid at the outlet of the pump to maintain a constant set horsepower. The torque limiter control 30 acts independently of the compensator override mechanism 62. As stated above, the pressure compensator override mechanism 62 only functions when the pressure of the working fluid at the outlet of the pump exceeds the setting of the override mechanism. Typically this setting is the maximum allowable system pressure.

Figure 2:
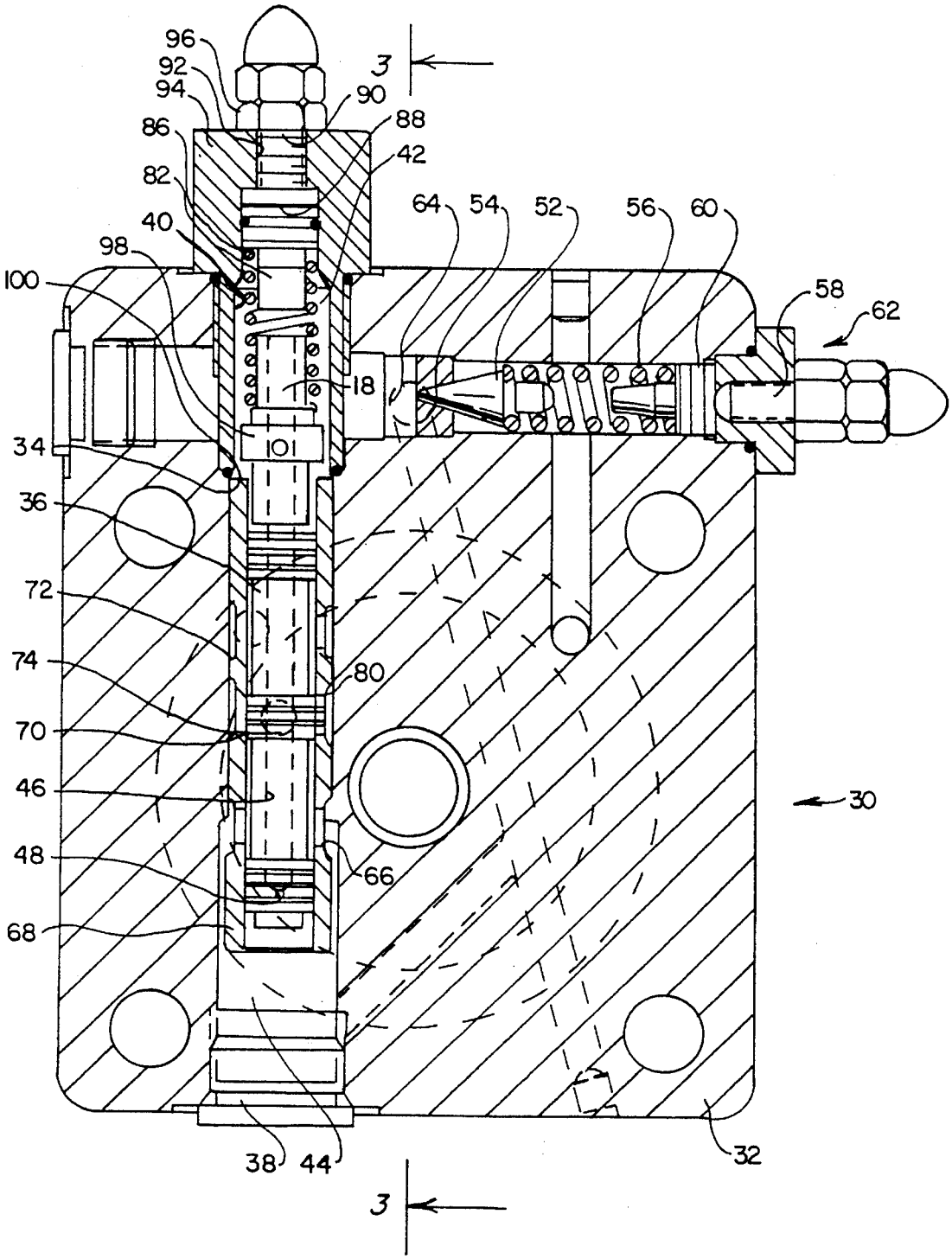
FIG. 2 is a view along line 2—2 of FIG. 1.

The torque limiter control 30 of the instant invention has a housing 32 containing a bore 34 which receives a slidable compensator metering spool 36 which may be seen by referring to FIG. 2. A plug 38 closes one end of bore 34 whereas the other end of bore 34 opens into an enlarged bore 40 which defines a spring cavity 42. A source of working pressure fluid from the outlet of pump 10 is provided to a cavity 44 adjacent one end of metering spool 36. The working pressure fluid in cavity 44 flows through a central bore 46 containing an orifice 48 in metering spool 36 and into a cavity 50 where it acts on a cone 52 resting within a seat 54 of a compensator override mechanism or device 62. Cone 52 is biased into seat 54 by a spring 56. A threaded adjustment screw 58 acts on a cylindrical post 60 which engages spring 56 to set the biasing force spring 56 exerts on cone 52. Adjustment screw 58, cylindrical post 60, spring 56, and cone and seat elements 52 and 54 constitute the major elements of compensator override mechanism 62 which sets the maximum allowable pressure of working fluid at the outlet of pump 10. When the pressure of the working fluid is sufficient to overcome the force of spring 56 and unseat cone 52, override mechanism 62 functions to reduce the displacement of the pump as will be described hereinbelow.

Figure 3:
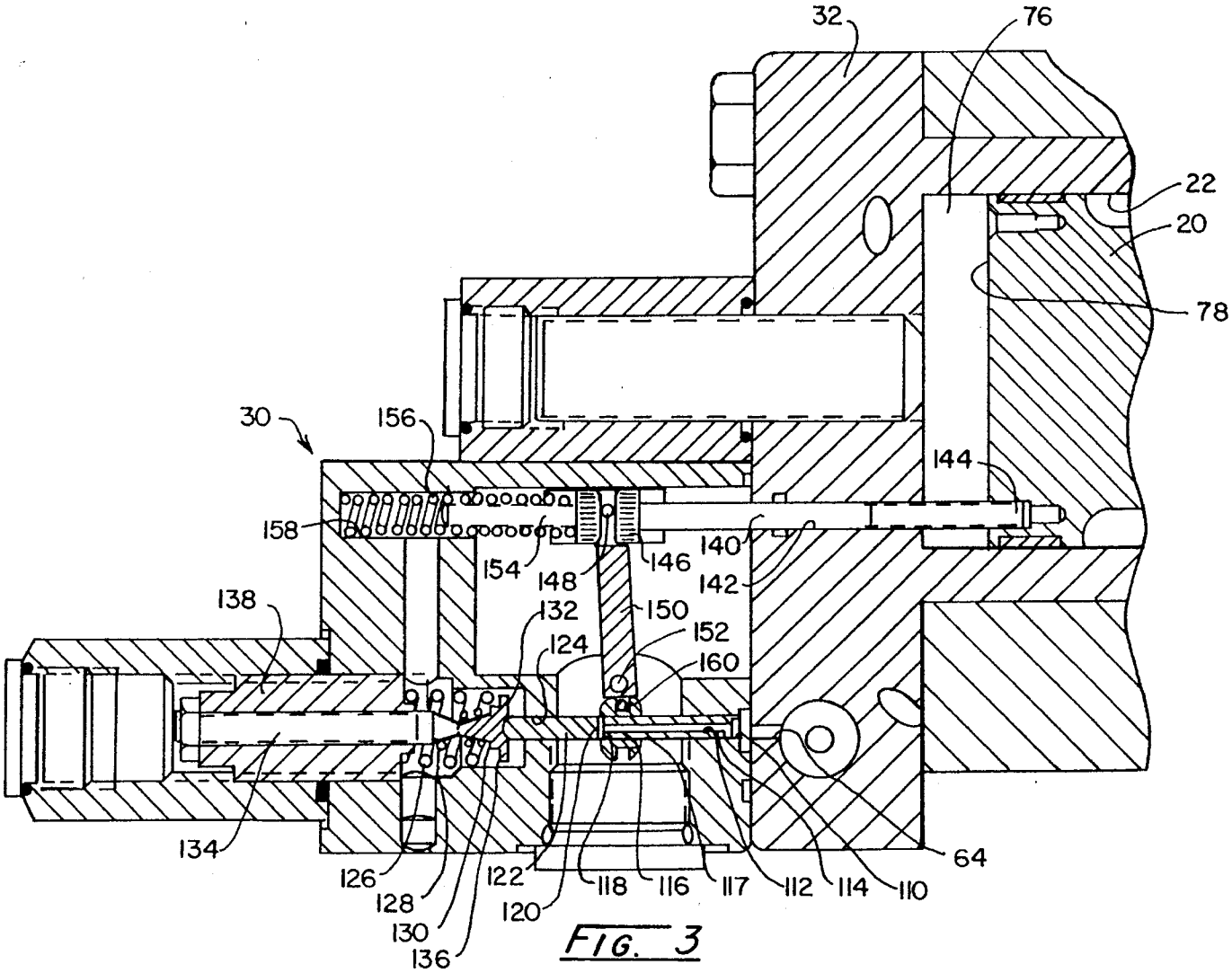
FIG. 3 is a view along line 3—3 of FIG. 2.

Working pressure fluid in cavity 50 also flows through a bore 64 the opposite end of which may be seen in FIG. 3.

Turning again to FIG. 2, it may be seen that working pressure fluid in cavity 44 also flows through a port 66 formed in a cylindrical housing 68 the inner surface of which defines metering spool bore 34. Fluid in port 66 flows around the outer surface of metering spool 36 until it encounters a land 70 in the central portion to the metering spool 36. Land 70 acts to seal bore 34. A bore or port 72 formed in housing 68 to the left of port 66 opens to low pressure or case. Consequently, one side of land 70 is exposed to working pressure fluid whereas the opposite side of land 70 is exposed to case pressure. A bore 74 formed in housing 68 is in fluid communication with cavity 76 adjacent one end 78 of control piston 20 seen in FIG. 3. Bore 74 is in fluid communication with a control port 80 also formed in housing 68. When metering spool 36 is positioned such that land 70 is moved to the right of control port 80, control port 80 and cavity 78 are open to case. When land 70 is moved to the left sufficiently to allow working pressure fluid to enter control port 80, cavity 76 becomes subjected to the pressure of working fluid at the outlet of the pump. This causes control piston 20 to move to the right. When land 70 overlies control port 80 no fluid flows into or out of the port and control piston 20 remains stationary. The movement of control piston 20 will be described hereinbelow.

Turning again to FIG. 2, it may be observed that compensator metering spool 36 has a cylindrical post 81 which projects into spring cavity 42. A spring 86 which occupies cavity 42 overlies cylindrical post 81 and one end 88 of an adjustment screw 90 to bias metering spool 36 to the right. Adjustment screw 90 is threadably received within a threaded bore 92 of a cap 94, the inner surface of which defines enlarged bore 40. A lock nut 96 secures the position of adjustment screw 90.

Spring 86 biases compensator metering spool 36 to the right until an enlarged land 98 engages a wall 100 defining the bottom of spring cavity 42. In this position of metering spool 36 control port 80 is connected to case. Thus, spring 26 is free to bias control piston 20 into a position of maximum pump displacement. Metering spool 36 moves to the left when working pressure fluid from the pump outlet in cavity 44 and in the center bore 46 of spool 36 begins to flow through the central bore creating a pressure differential across orifice 48 sufficient to overcome the force of spring 86. Such a flow of outlet pressure fluid occurs when the pressure of the working fluid at the pump outlet exceeds the setting of compensator override device 62 and causes cone 54 to unseat to allow the flow of fluid therethrough. When this occurs, spool 36 and land 70 move to the left of control port 80 to a position in which control port 80 receives working pressure fluid and such fluid passes through bore 74 into cavity 76 to act on end 78 of control piston 20. When the force of the fluid in cavity 76 acting on surface 78 is sufficient to overcome the force of spring 26, control piston 20, as viewed in FIG. 1, moves to the right to pivot rocker cam 14 and reduce the displacement of pump 10. When the displacement of the pump has been reduced to sufficiently cause the pressure of the working fluid of the pump outlet to fall below the setting of compensator override device 62, spring 56 will cause cone 52 to seat and fluid flow through orifice 48 will cease. When this occurs, spring 86 causes compensator metering spool 36 to move to the right until land 70 overlies control port 80 which prevents the flow of working pressure fluid from port 66 to cavity 76 and prevents the flow of pressure fluid in cavity 76 to case. This maintains the position of the control piston 20. If the pressure of working fluid drops below the setting of compensator override device 62 compensator metering spool 36 will continue to move to the right to uncover control port 80 such that pressure fluid in cavity 76 may flow to case. As this occurs, spring 26 urges control piston 20 to the left as viewed in FIG. 1 to move rocker cam 14 towards a position of maximum fluid displacement.

As mentioned previously, working pressure fluid connected to the central bore 46 of compensator metering spool 36 is connected in parallel to compensator override mechanism 62 and to bore 64 which is in fluid communication with the torque limiter control mechanism 10 of the instant invention. This mechanism utilizes the compensator metering spool 36 to operate control piston 20 to adjust the displacement of pump 10 to maintain a constant set horsepower limit as will now be described. Turning to FIG. 3, it may be observed that working pressure fluid in bore 64 flows into a housing bore 110 and thereafter into a central, axial bore 112 of a hollow vent sleeve 114 having one end slideably mounted within housing bore 110. Vent sleeve 114 is slidably mounted within a central bore 117 of a clevis or feedback sleeve 116. The outer end 118 of central, axial bore 12 intersects a lateral bore 120. The opposite end 122 of vent sleeve 114 is slidably mounted in housing bore 124. Clevis 116 overlies and closes lateral bore 120 to prevent the exit of pressure fluid therefrom as will be described hereinbelow.

Vent sleeve 114 is urged to the right by a pair of springs 126 and 128. Spring 128 is clamped between a first flat surface 130 formed on a hat shaped plate 132 mounted at one end of vent spool 122 and a threaded adjustment member 134. Spring 126 is clamped against a second flat surface 136 formed on plate 132 and a threaded adjustment member 138. It may be seen that the threaded adjustment members 134 and 138 may be adjusted independently of each other to thereby apply different forces on springs 128 and 126 acting on the end of vent sleeve 114. It has been found that the use of two springs 126 and 128 to set the initial pressure of the torque limiter mechanism 30 enables the device to maintain a more exact set horsepower throughout the operating range of the torque limiter device 30 than a single spring. The adjustment members 134 and 131 serve to set or define the horsepower or torque limit which may be input to the pump 10.

Referring again to FIG. 3, it may be seen that a feedback pin 140 slides in a housing bore 142 and has one end 144 rigidly affixed to control piston 20. The opposite end 146 of feedback pin 140 is engaged by a pin 148 mounted at one end of a pivotal feedback link 150. The lower end of feedback link 150 supports a pin 160 mounted within clevis or feedback sleeve 116. Feedback link 150 pivots about a rigidly mounted pin 152. A T-shaped plunger 154 engages pin 148. A spring 156 mounted within a housing bore 158 serves to bias plunger 154 against pin 148 and clamp the pin against the end 146 of feedback pin 140.

Consequently, movement of control piston 20 causes feedback link 150 to pivot about pin 152 and thereby slide clevis 116 relative to vent sleeve 114 in a direction opposite to the direction control piston 20 moves. In other words, if control piston 20, as seen in FIG. 3, moves to the right, feedback link 150 pivots clockwise and clevis 116 is moved to the left. If control piston 20 is moved to the left, feedback link 150 pivots counterclockwise and clevis 116 moves to the right. Thus, it may be seen that clevis 116 moves with respect to vent sleeve 114 to adjust or modulate the pressure setting of the device as movement of control piston 20 causes pump displacement to change.

As mentioned previously, adjustment members 134 and 138 cause springs 128 and 126 respectively to bias vent sleeve 114 to the right. So long as clevis 116 overlies and closes lateral bore 120, working pressure fluid is prevented from flowing from central axial bore 112 of sleeve 114. Consequently, adjustment members 134 and 138 provide an initial torque limit setting for the pump 10. As the pressure of working fluid increases, the force of the fluid acting on the area of vent sleeve 114 ultimately overcomes the force applied by springs 126 and 128 and moves vent sleeve 114 to the left with respect to clevis 116 to uncover lateral bore 120. This causes fluid to start to leak at the interface of the lateral bore 120 and clevis 116. As fluid flows at this interface, fluid flows through metering spool bore 46 and through orifice 48 in compensator metering spool 36. When the pressure differential across orifice 48 becomes sufficient to cause the spool to move to the left and connect working pressure fluid in port 66 to control port 80, the working pressure fluid will flow through bore 74 and into cavity 76 to act against the end 78 of control piston 20. As the pressure within cavity 76 increases, the force acting on control piston 20 ultimately will be sufficient to overcome the resisting force of spring 26. This will cause control piston 20 to move to the right and pivot rocker cam 14 to a position of less fluid displacement.

Turning again to FIG. 3, it may be observed that as control piston 20 moves to the right, feedback pin 140 causes feedback link 150 to pivot clockwise causing clevis 116 to slide to the left along vent sleeve 114 to overlie and close lateral bore 120. In other words, as the pump displacement is reduced, clevis 116 is moved leftward along vent sleeve 114 to effectively increase the amount of pressure of the working fluid required to cause a fluid flow at the vent sleeve/clevis 120 and 116 interface. Similarly, as the pressure of the working fluid falls, and compensator metering spool 36 moves to the right, cavity 76 behind control piston 29 is opened to tank to enable spring 26 to move control piston 20 to the left. As this occurs, feedback link 150 is pivoted counterclockwise and clevis 116 is moved to the right along vent sleeve 114. This effectively reduces the pressure of working fluid required to cause fluid flow at the vent sleeve/clevis 120 and 116 interface. Thus, the pressure setting at the vent sleeve clevis interface is modulated as the pump displacement is changed.

Operation of the torque limiter control 30 of the instant invention now will be described by referring to FIGS. 1, 2, 3 and 6. Turning to FIG. 3, adjustment members 134 and 138 are rotated to cause there respective springs 128 and 126 to apply initial forces to be applied to vent sleeve 114. The predetermined forces applied by springs 128 and 126 provide an initial torque limit for the amount of power which may be input to pump 10. Two springs 126 and 128 are incorporated into the torque limiter control 30 in order to increase the accuracy of the device. Although horsepower is a function of the inverse ratio of pump displacement and working pressure, the relationship is not linear. Accordingly, in order to more closely approximate the horsepower curve, two springs 126 and 128 are used. Each spring covers a segment of the horsepower curve. As more springs are used to cover shorter segments of the horsepower curve the accuracy of the torque limiter control 30 increases. It has been found that the torque limiter control 30 holds a set torque or horsepower input within a range of 3 to 5 percent when two springs are used.

After the torque limiter control 30 has been set to a desired maximum horsepower which may be input to pump 10, the control 30 automatically modulates the displacement of the pump and the pressure of the working fluid which may be output from the pump. Normally, the pressure of the working fluid will remain well within the operating limits of the pump. However, in some cases it may be possible for the working fluid pressure to exceed the preferred operating limits of the pump or hydraulic system for a given displacement of the pump and still fall within the range of the horsepower limit setting of the device 30. Accordingly, in order to prevent damage to the system caused by excessive working fluid pressure, the compensator override device 62 may be adjusted to limit the maximum pressure of the working fluid. Of course, the torque limiter device 30 operates independently of the compensator override device 62 and such a device is not required for a torque limiter control. Turning to FIG. 2, threaded adjustment screw 58 may be rotated to apply force on spring 56 which provides a setting for the compensator override device 62.

After the torque limiter control 30 and compensator override device 62 have been set, pump 10 is placed in operation. Working pressure fluid enters cavity 44 at the end of compensator metering spool 36 and flows through port 66 to one side of metering spool land 70. Additionally, the working pressure fluid flows through orifice 48 and central bore 46 of metering spool 36. Thereafter it flows in parallel to the end of cone 52 of compensator override device 62 and through bore 64 into the central axial bore 112 of vent sleeve 114. This fluid acts to bias sleeve 114 to the left. So long as the pressure of the working fluid at the outlet of pump 10 does not change, the system will remain in equilibrium, compensator metering spool 36 will remain in the position depicted in FIG. 2 in which land 70 overlies control port 80, control piston 20 will remain stationary and lateral bore 120 of vent sleeve 114 will remain in position in which it is closed by clevis 116.

However, should the pressure of the working fluid at the outlet of pump 10 begin to fall, metering spool 36 will see less pressure and will move to the right and control port 80 connected to the control piston 20 will open to tank. This will enable spring 26 to move control piston 20 to the left to put the pump more on stroke. As this occurs, feedback pin 140 will move to the left and pivot feedback link 150 counterclockwise about pin 152. This will slide clevis 116 to the left along vent sleeve 114.

When the pressure of the working fluid applied to vent sleeve 114 exceeds the clamping force of springs 126 and 128, vent sleeve 114 will move to the left and uncover lateral port 120 and pressure fluid will flow through the interface of the vent sleeve and clevis 120 and 116. When this flow becomes sufficient to cause a pressure drop through orifice 48 sufficient to move compensator metering spool 36 to the left, land 70 will uncover control port 80 and working pressure fluid in port 66 will flow through bore 74 and into cavity 76 to exert a force on control piston 20. This force will cause control piston 20 to move to the right to reduce the displacement of the pump. As this occurs, feedback pin 140 moves to the right and spring 156 and plunger 154 cause feedback link 150 to pivot clockwise about pin 152. This in turn moves clevis 116 to the left to overlie lateral bore 120 of sleeve 14 and thereby effectively increase the pressure of the working fluid required to move compensator metering spool 36 to the left.

Compensator metering spool 36 also moves to the left to cause working pressure fluid in port 66 to enter control port 80 to reduce the displacement of the pump when the pressure of the working fluid exceeds the setting of compensator override device 62. When this occurs, the pressure fluid will cause cone 52 to lift from seat 54 and thereby create a flow through orifice 48. This flow creates the pressure drop across compensator metering spool 36 which moves the compensator piston to the left.

In the torque limiter control 30 depicted in FIGS. 1 through 3 and 6, the torque or horsepower limit was set manually by rotating a pair of threaded adjustment screws 134 and 138 to load a pair of springs 128 and 126. A displacement control 170 having a different type of manual displacement setting mechanism may be seen by referring to FIG. 5. Components identified to those of torque limiter control 30 are identified by identical primed numbers. In this embodiment a cylindrical linear movement member 172 has a vertical end face 173 which contacts a plate 174 which engages the end of vent sleeve 114' which in turn is biased by a spring 175. A cam 176 is formed on the outer surface 178 of linear adjustment member 172. Cam 176 resides within a spiral groove 180 formed in an adjustment element 182. A cylindrical extension member 184 projects axially of adjustment member 172. Rotating cylindrical extension member 184 in one direction or another will rotate adjustment element 182 and cam 176 will follow groove 180 to move member 172 linearly in one direction or the other to thereby cause sleeve 114 to move with respect to clevis 116 to thereby set the displacement of the pump.

Figure 4:
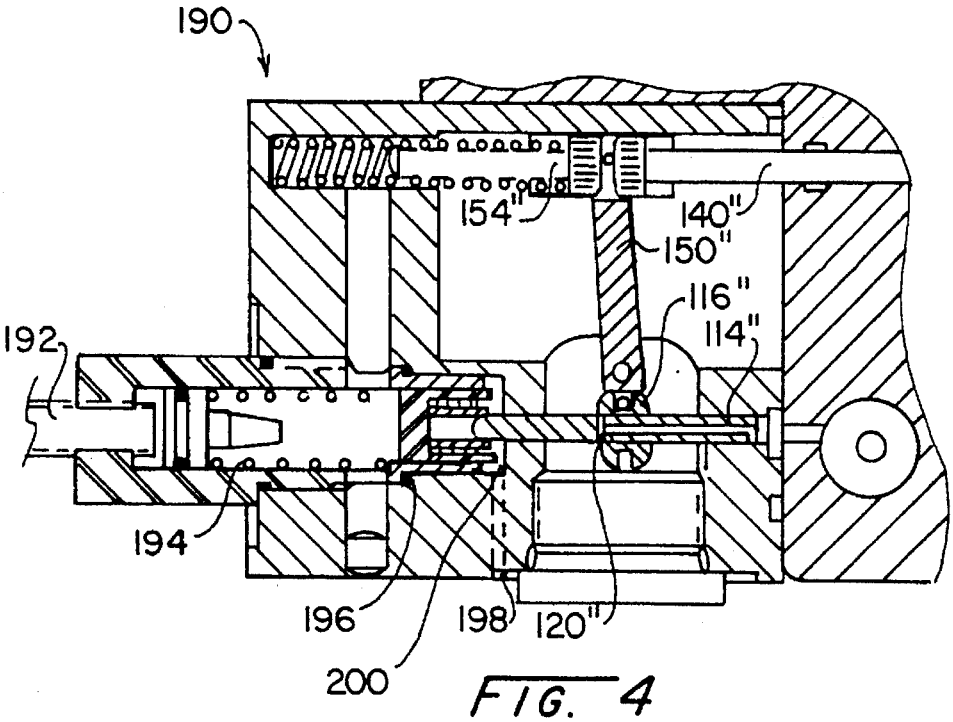
FIG. 4 is a sectional view of a hydraulically adjustable displacement control which may be substituted for the manually adjustable control illustrated in FIG. 3.
Figure 5:
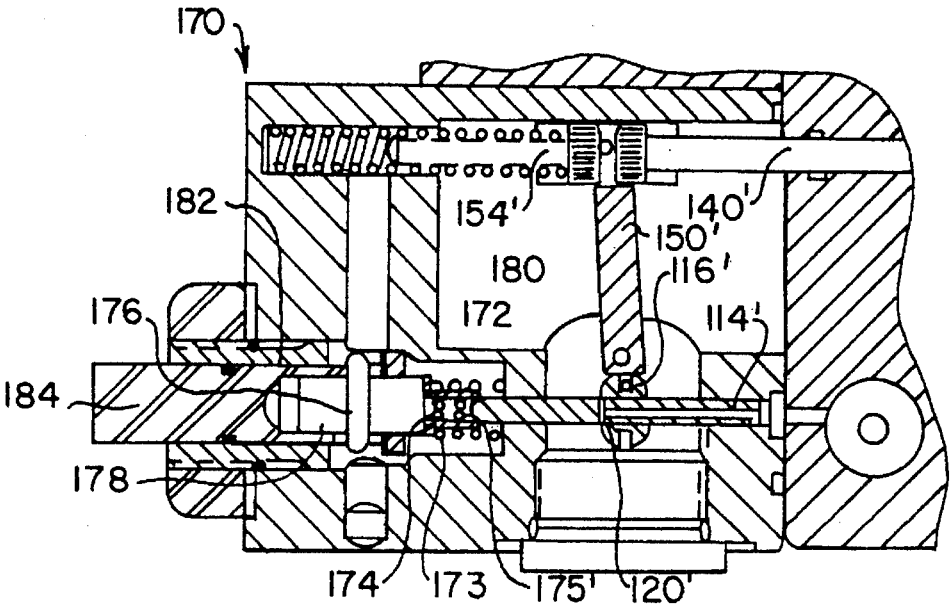
FIG. 5 is a sectional view showing another type of manual positioning device utilized to drive the vent spool in a manually adjustable displacement control.

A displacement control 190 which may be adjusted from a remote location may be seen by referring to FIG. 4. Elements of the displacement control 190 which are identical to those of the torque limiter control 30 discussed in connection with the preferred embodiment of the invention are identified by identical double prime numerals. In control 190, a threaded adjustment member 192 acts on a spring 194 to bias a spool element 191 against the end of vent sleeve 114. This provides an initial minimum displacement setting for the pump. A housing bore 198 opens into a chamber 200 which is defined by one side of spool element 196. Bore 198 receives control pressure fluid from a remote source to increase the displacement setting of pump 10. Initially adjustment member 192 is adjusted to provide a minimum control pressure setting at which the pump goes on stroke. This setting is adjusted upwardly by the introduction of control pressure fluid into bore 198 and fluid chamber 200. As pressurized fluid is introduced into chamber 200 it applies a force to spool member 196 in opposition to spring 194 and vent sleeve 114" is moved to the left to uncover lateral bore 120 in clevis 116. Thus, it may be observed that control pressure fluid may be introduced into chamber 200 to change the displacement setting of the pump 10. The device controlling the flow of control pressure fluid to chamber 200 may be at a remote location.

Turning to FIGS. 6 and 7, FIG. 6 is a schematic drawing of the hydraulic system utilized in connection with the torque limiter control 30 described in connection with the preferred embodiment of the subject invention. Working pressure fluid is provided from the outlet of pump 10 at line P. FIG. 7 is a schematic diagram of the hydraulic system employed in connection with the hydraulically adjusted displacement control 190 shown in detail in FIG. 4. This system is shown as being fed a pressure or control fluid P from a servo pump S. The system operates in the same manner as a system utilizing pressure fluid from the outlet of the pump.

From the above, it may be seen that the torque limiter control of the instant invention may be adjusted easily to set a limit as to the amount of a horsepower which may be absorbed by a pump controlled by the device. The torque limiter control components may be utilized to provide a displacement control which may be adjusted manually or hydraulically. In connection with the hydraulic adjustment, typically the device may be an electro-hydraulic device in which an electrically controlled servo valve controls the flow of control pressure fluid to the torque limiter control. Regardless, the displacement control may be adjusted from a remote location by any convenient means.

Since certain changes may be made in the above-described system and apparatus without departing from the scope of the invention herein and above, it is intended that all matter contained in the description or shown in the accompanying drawings shall be interpreted as illustrative and not in a limiting sense.

I claim my invention as follows:

1. A torque limiter control for setting the power output of a variable displacement, pressure compensated pump having an inlet and a working pressure fluid outlet, a movable swash plate, a movable control piston mounted in a first bore and attached to said swash plate for setting the displacement of the pump and movable between a first control position of maximum pump displacement and a second control position of minimum pump displacement and spring means for spring biasing said control piston toward said first position which comprises:

a housing having a second bore for receiving a metering compensator spool, a tank port adapted to be connected to case which opens into said second bore, an outlet port adapted to receive control pressure fluid which opens into said second bore, and a control port adapted to be connected to said first bore of said control piston and said second bore;

a metering compensator spool slidable mounted in said second bore having a metering orifice and a metering land and movable between a first spool position in which said outlet port is in fluid communication with said control port such that control pressure fluid is directed to said control piston to move said control piston toward said second control position, a second spool position in which said tank port is in fluid communication with said control port such that pressure fluid is drained from said control piston to enable said spring means to bias said control piston toward said first control position and an intermediate position in which said control port is blocked by said land;

a source of control pressure fluid connected to said metering orifice and said second bore;

a hollow vent sleeve having a vent port slidable in a third bore which bore is downstream of and in fluid communication with said metering orifice such that said vent port receives control pressure fluid which passes through said metering orifice;

a slidable clevis which receives said vent sleeve and overlies said vent port;

a torque limiter set adjustment which applies a torque setting force to said vent spool to bias said vent sleeve such that said clevis overlies said vent port to prevent fluid in said vent port from exiting said vent port and thereby causing a pressure drop across said metering orifice until the pressure of said control fluid provides a force which exceeds that of said torque limiter set adjustment;

a feedback pin connected to and movable with said control piston to indicate pump displacement; and a pivotal feedback link drivingly connected to said feedback pin and to said vent sleeve such that said feedback link causes said clevis to slide along said vent sleeve in response to movement of said control piston and thereby modulate said torque setting force at the interface of said vent port and said clevis as pump displacement changes.

2. The torque limiter control of claim 1 further comprising a pressure compensator override assembly in fluid communication with and downstream of said metering orifice adapted to receive working pressure fluid and to limit the maximum pressure of said working fluid at said pump outlet.

3. The torque limiter control of claim 1 further comprising an adjustable spring in said torque limiter set adjustment which may be adjusted to apply said torque setting force.

4. The torque limiter control of claim 3 in which said manually adjustable spring incorporates a pair of individual springs.

5. A displacement control for setting the displacement of a variable displacement, pressure compensated pump having an inlet and a working pressure fluid outlet, a movable swash plate, a movable control piston mounted in a first bore and attached to said swash plate for setting the displacement of the pump and movable between a first control position of maximum pump displacement and a second control position of minimum pump displacement and spring means for spring biasing said control piston toward said first position which comprises:

a housing having a second bore for receiving a metering compensator spool, a tank port adapted to be connected to tank which opens into said second bore, an outlet port adapted to receive working pressure fluid from said pump outlet which opens into said second bore, and a control port adapted to be connected to said first bore of said control piston and said second bore;

a metering compensator spool slidable mounted in said second bore having a metering orifice and a metering land and movable between a first spool position in which said outlet port is in fluid communication with said control port such that working pressure fluid is directed to said control piston to move said control piston toward said second control position, a second spool position in which said tank port is in fluid communication with said control port such that pressure fluid is drained from said control piston to enable said spring means to bias said control piston toward said first control position and an intermediated position in which said control port is blocked by said land;

a source of working pressure fluid connected to said metering orifice and said second bore;

a hollow vent sleeve having a vent port slidable in a third bore which bore is downstream of and in fluid communication with said metering orifice such that said vent port receives working pressure fluid which passes through said metering orifice;

a slidable clevis which receives said vent sleeve and overlies said vent port;

a displacement adjustment which applies a force to said vent sleeve such that said clevis overlies said vent port to prevent fluid in said vent port from exiting said vent port at its interface with said clevis and thereby cause a pressure drop across said metering orifice until the pressure of said working fluid provides a force which exceeds that of said set adjustment;

a feedback pin connected to and movable with said control piston to indicate pump displacement; and a pivotal feedback link drivingly connected to said feedback pin and to said vent sleeve such that said feedback link causes said clevis to slide along said vent sleeve in response to movement of said control piston and thereby modulate said displacement setting force at the interface of said vent port and said clevis as pump displacement changes.

6. The displacement control of claim 5 further comprising a pressure compensator assembly in fluid communication with and downstream of said metering orifice adapted to receive working pressure fluid and to limit the maximum pressure of said working fluid at said pump outlet.

7. The displacement control of claim 5 further comprising an adjustable spring in said displacement adjustment which applies said initial setting force.

8. The displacement control of claim 5 further comprising a hydraulic stroking piston in said displacement control which adjusts the displacement setting.

* * * * *